US007870810B2

(12) United States Patent
Da Dalt et al.

(10) Patent No.: US 7,870,810 B2
(45) Date of Patent: Jan. 18, 2011

(54) ROTARY KNOB FOR ELECTRICAL SYSTEM

(75) Inventors: Hugues Da Dalt, Champniers (FR); Patrice Thizon, Ruelle-sur-Touvre (FR); Bertrand Fruchard, Angouleme (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 1106 days.

(21) Appl. No.: 10/594,331

(22) PCT Filed: Mar. 14, 2005

(86) PCT No.: PCT/EP2005/051144

§ 371 (c)(1),
(2), (4) Date: Sep. 27, 2006

(87) PCT Pub. No.: WO2005/106908

PCT Pub. Date: Nov. 10, 2005

(65) Prior Publication Data

US 2007/0199806 A1 Aug. 30, 2007

(30) Foreign Application Priority Data

Mar. 30, 2004 (FR) ..... 04 03265
Mar. 30, 2004 (FR) ..... 04 03266

(51) Int. Cl.
*G05G 1/10* (2006.01)
*G05G 5/06* (2006.01)
*F16H 53/00* (2006.01)
*H01H 3/08* (2006.01)

(52) U.S. Cl. ..... 74/553; 74/527; 74/569; 200/6 A; 200/16 A; 200/325; 200/336

(58) Field of Classification Search ..... 74/553, 74/527, 567, 569; 200/5 R, 11 R, 16 A, 325, 200/336; 70/DIG. 30, 370
See application file for complete search history.

(56) References Cited

U.S. PATENT DOCUMENTS 3,247,349 A 4/1966 Duncan
3,517,570 A * 6/1970 Kolb ..... 74/527
3,770,926 A 11/1973 Wanner (Continued)

FOREIGN PATENT DOCUMENTS

DE 34 12 517 10/1985

(Continued)

OTHER PUBLICATIONS

U.S. Appl. No. 11/815,774, filed Aug. 8, 2007, Thizon, et al.

*Primary Examiner*—Vinh T. Luong
(74) *Attorney, Agent, or Firm*—Oblon, Spivak, McClelland, Maier & Neustadt, L.L.P.

(57) ABSTRACT

A rotary knob for an electrical system includes a body containing a rotary maneuvering member which actuates a cam-driving part and bears one or more electrical units. A cup is defined between an outer cylindrical flange of the body and an inner cylindrical sleeve, and contains a spring either of a helical type for urging a sliding ring separate from the driving part, or of a torsion type to return the maneuvering member. The ring provides a sensitivity function. The cylindrical sleeve defines in a central opening thereof a centering seat of the shank of the maneuvering member.

10 Claims, 5 Drawing Sheets

U.S. PATENT DOCUMENTS

| | | | | |
|---|---|---|---|---|
| 3,919,506 | A * | 11/1975 | Kellogg | 200/16 A |
| 5,862,715 | A | 1/1999 | Lemire | |
| 6,072,128 | A * | 6/2000 | Ansorge et al. | 200/5 R |
| 2008/0141744 | A1 * | 6/2008 | Desaphie et al. | 70/344 |

FOREIGN PATENT DOCUMENTS

| | | |
|---|---|---|
| DE | 35 41 390 | 8/1986 |
| FR | 2 061 317 | 6/1971 |
| GB | 2 102 206 | 1/1983 |

* cited by examiner

ROTARY KNOB FOR ELECTRICAL SYSTEM

BACKGROUND OF THE INVENTION

I. Field of the Invention

The present invention relates to a rotary knob for an electrical system, comprising a body on which can be mounted a rotary maneuvering member, in particular a hand grip or a rotor controlled by a key, and of housing a driving part for switching contacts.

II. Description of Related Art

In conventional rotary knobs, the maneuvering member is provided with a shank for moving the driving part, and the body also serves as a support for at least one electrical contact block, switchable in response to the rotation of the maneuvering member via at least one axially moving slider. The maneuvering member is mounted on the body such that it rotates about an axis with a limited angular movement, in order to assume at least two functional positions, maintained or transitory. Rotary knobs of this type are well known (see for example the documents DE 34 12 518 and DE 35 41 390). The maneuvering member is locked in rotation with a driving part having a cam able to actuate the slider or sliders and the body is able to receive the hand grip in a fluid-tight manner, to serve as a support for the electrical blocks and to house the driving part and the sliders.

These knobs sometimes have the disadvantage that, although the maneuvering member is placed in one of its functional positions, a slight force applied to that member can suffice to make a notch of the cam jump and to drive the knob in an inopportune manner.

BRIEF SUMMARY OF THE INVENTION

The purpose of the invention, in a rotary knob of the type described, is to overcome the disadvantages of the prior art by proposing a knob providing satisfactory guidance of the rotary part using means conferring the knob with minimal dimensions, in particular height, and facilitating assembly.

Another purpose of the invention is to propose means making it possible to improve the fluid-tightness of such knobs.

According to the invention, the body of the knob has a recessed part provided with an external cylindrical flange, an internal cylindrical sleeve, and a cup defined between the flange and the sleeve for housing a helical spring acting on a sensitivity ring separate from the driving part and movable in translation or, respectively, a torsion spring acting on the maneuvering member, and the cylindrical sleeve defines a central opening with which a centering seat of the shank of the maneuvering member cooperates. The arrangement resulting form this provides the sought sensitivity whilst maintaining small dimensions.

In order to achieve an excellent centering at the level of the sleeve, the shank of the maneuvering member and the driving part can each have a cylindrical seat ensuring the centering, in the central opening of the sleeve, of the rotary equipment consisting of the maneuvering member and the driving part.

In order to facilitate the assembly of the knob, the driving part can be mounted by means of interlocking shapes on the shank of the maneuvering member and provide a shoulder connected to its seat for being applied axially against a bearing face of the body.

When the spring is a compression spring, the cup preferably also houses the sensitivity ring, and the ring:

- is separate from the driving part, and is coaxial with the maneuvering member and movable in translation,
- has a diametral size corresponding to that of the cup, and
- cooperates with the maneuvering member by means of cam shapes provided on their respective peripheries and provided with notches corresponding to the functional positions of the knob.

The rotary equipment, formed by the shank of the maneuvering member and the driving part, can carry a lip seal of small diameter which cooperates in rotation with the central opening of the cylindrical sleeve substantially at the level of the cup.

Between the external cylindrical flange of the body and the cup, it is possible to provide an annular space, stepped with respect to the cup, able to house a sealing device.

According to a first variant embodiment, the sealing device comprises a guard ring intended to retain the sensitivity ring and housed in the stepped annular space of the body. The head of the hand grip can be provided with a reentrant annular rim which is housed in the staged annular space of the body. Thus the annular rim of the hand grip and the guard ring define between them a first radial annular interstice between the flange and the annular rim and a second radial annular interstice between the annular rim and the cylindrical skirt, the two interstices in series forming a sealing chicane. The guard ring contributes to forming a barrier against the introduction of dust, polluting elements or projections inside the body of the rotary knob, and the two interstices together avoid, in normal conditions of use, having to make use of a sealing gasket of large diameter.

According to a second variant embodiment, the sealing device can be constituted by a conventional lip seal provided in the stepped annular space.

For purposes of compactness, the compression spring housed in the cup can advantageously have a height of substantially the same order as the height of the cylindrical sleeve.

When the spring is a torsion spring, a chicane sealing device can be provided between the cylindrical flange of the body and can comprise a skirt of the grasping head and an intermediate cylindrical flange of the body separating the cup from the annular space. The torsion spring and the intermediate flange advantageously have a height substantially of the same order as the height of the cylindrical sleeve.

The following detailed description, referring to the appended drawings, illustrates an embodiment given by way of example.

DETAILED DESCRIPTION OF THE INVENTION

Figure 1:
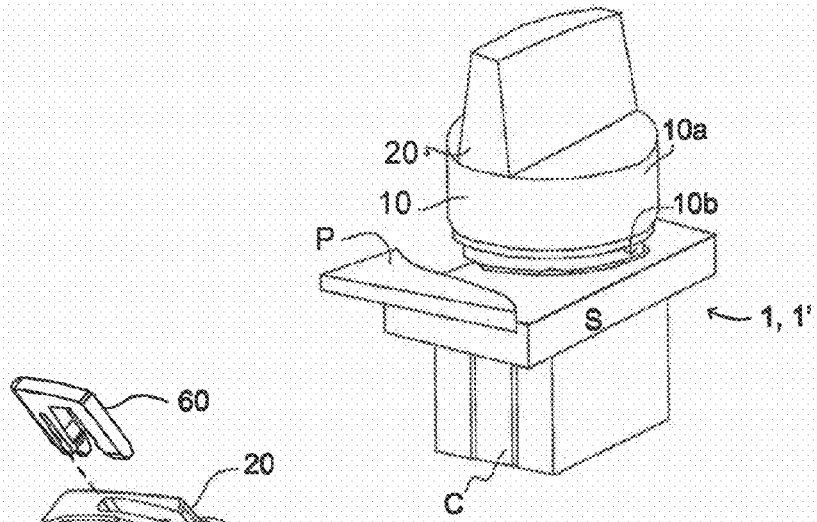
FIG. 1 is a diagrammatic representation in perspective of a rotary knob according to the invention, with its contact blocks.
Figure 2:
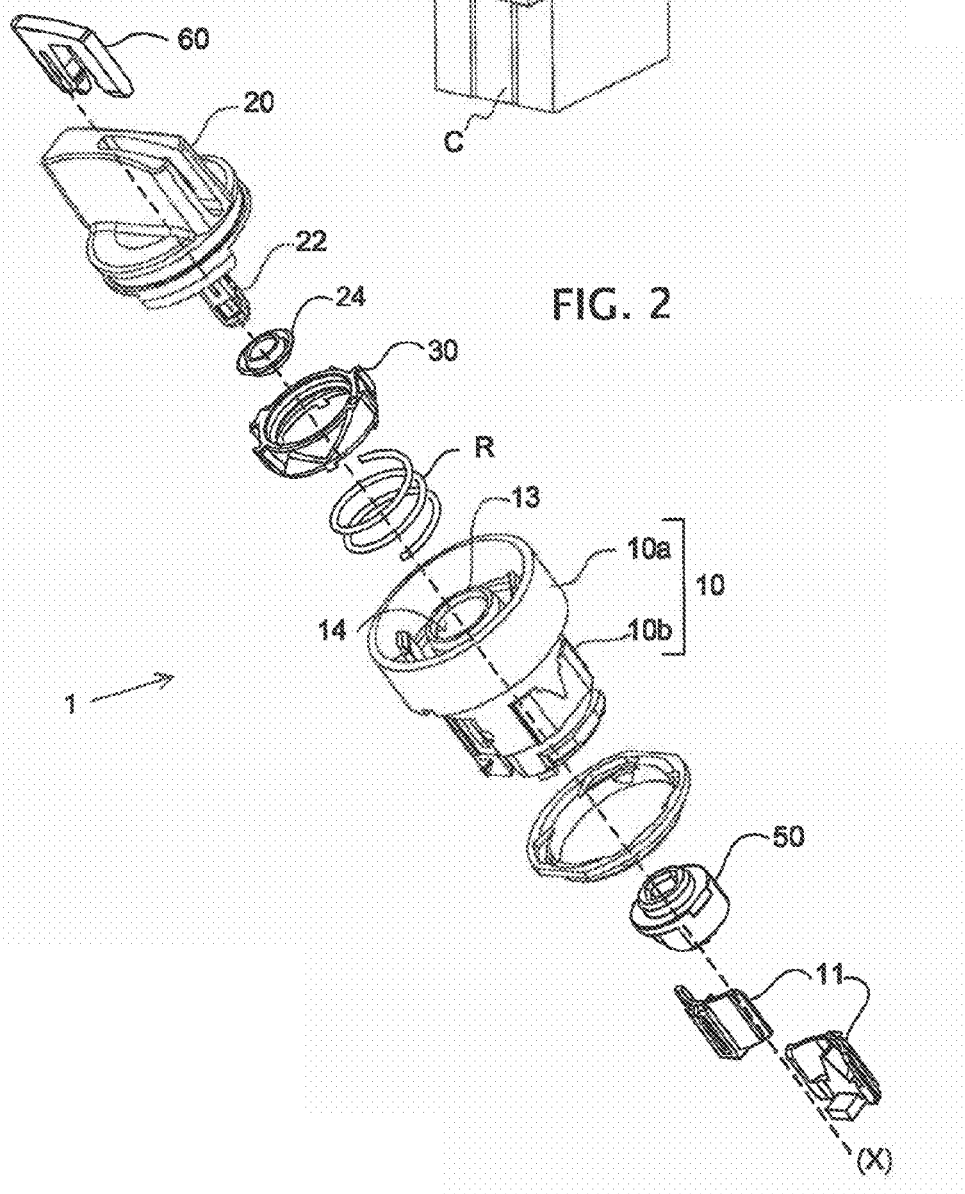
FIG. 2 is an exploded view of a rotary knob with maintained positions.
Figure 3:
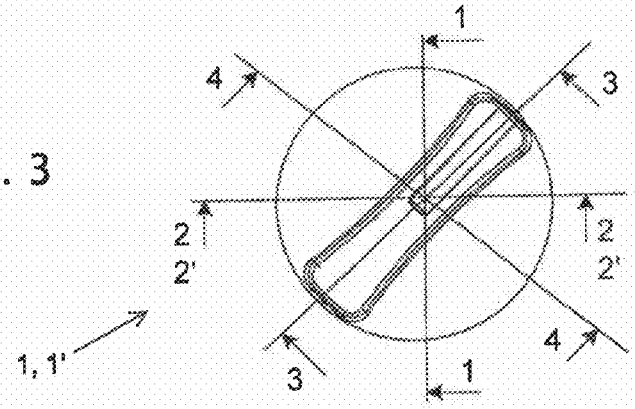
FIG. 3 is a diagrammatic plan view of a rotary knob with maintained or transitory positions according to the invention.

The rotary knob 1, 1' shown in the figures comprises a body 10 which carries a maneuvering member 20 which rotates about an axis X. In the present example, the member 20 is a hand grip, but it can also be a cylinder operated by a key. The body 10 of the knob is designed to be fixed in an opening formed in a panel or a wall P, for example by means of a normal fixing base S. Electric contact blocks C are integral with the body or the base in order to be switched according to the position given to the hand grip 20. The hand grip 20 is mounted such that it rotates in the body with a limited angular movement, in order to assume at least two functional positions, maintained or transitory.

The body 10 of the knob has a recessed top part 10*a* and a narrower bottom driving part 10*b*. The bottom part 10*b* of the body comprises straight shapes for guiding sliders 11 which move in translation, in response to the rotation of the hand grip and under the action of a drive part 50 rotationally coupled to the hand grip. The sliders 11 move in a direction parallel with the axis X in order to become applied on push rods that are part of the blocks C. The push rods are pushed back against the sliders 11 by individual springs.

The hand grip 20 comprises in its grasping head 21, embedded in the latter, an indicator 60, whose function is to mark the angular position of the hand grip. This indicator 60 is for example interlocked in a slot formed in the grasping head 21.

In the rest of the description, the use of the terms "axial", "axially", "coaxial" or "transverse" are defined with respect to said axis X.

Similarly the terms "high", "low", "upper", "lower", above", "below" or equivalent directional terms must be understood to be with respect to said axis X when the latter is vertical.

Figure 6:
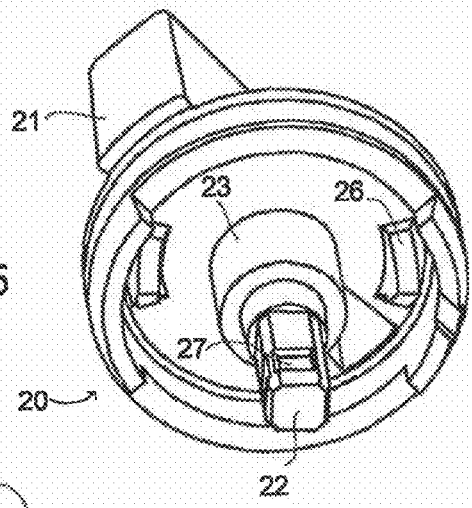
FIG. 6 is a bottom view of the hand grip of the rotary knob according to the invention.
Figure 7:
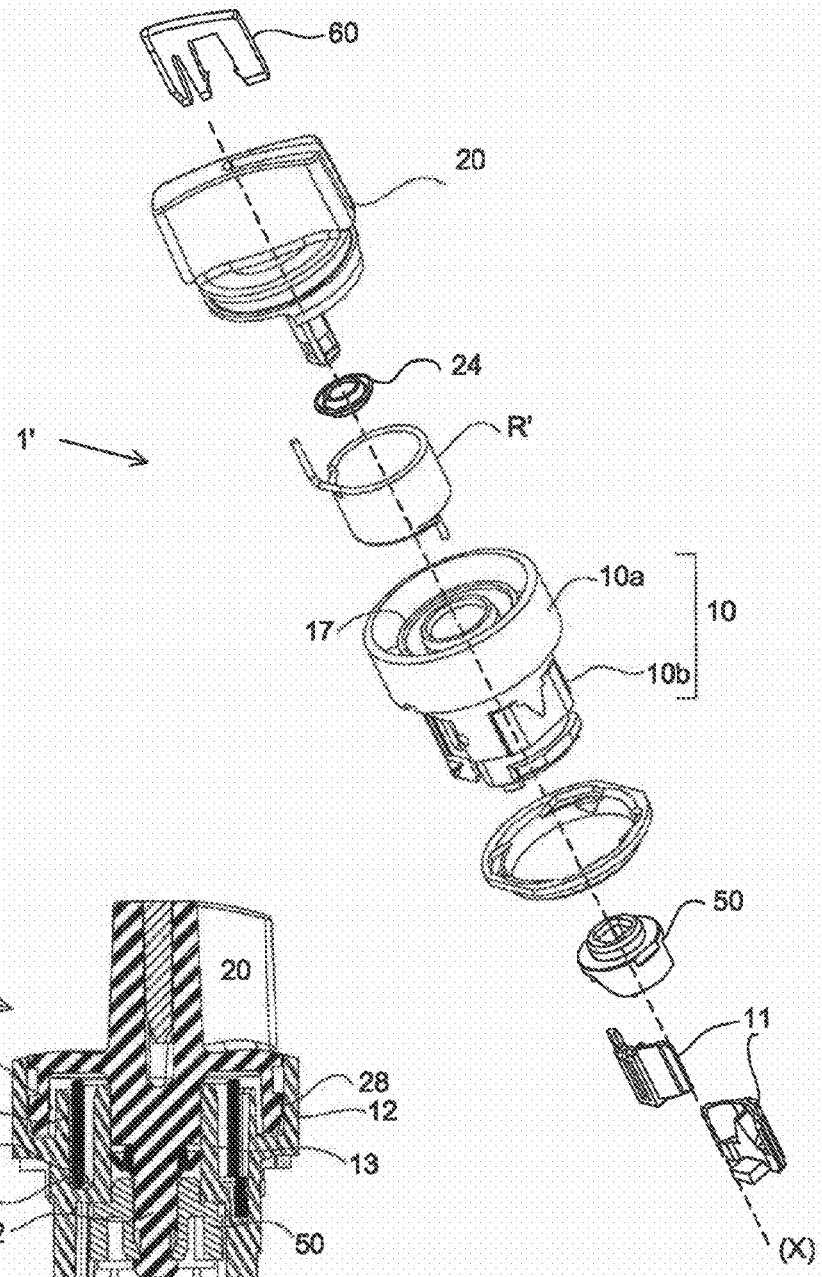
FIG. 7 is an exploded view of so-called return knob.
Figure 8:
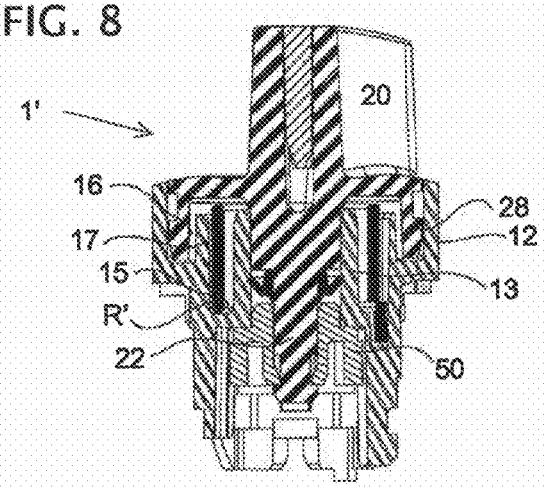
FIG. 8 is a longitudinal axial cross-sectional view of the rotary return knob shown in FIG. 7, through 4B'-4B' of FIG. 3.

The recessed part 10*a* of the body is provided with an external cylindrical flange 12 and with an internal cylindrical sleeve 13, the latter defining a central opening 14. Moreover, the flange 12 and the sleeve 13 define between them a cup 15 which houses, in a first embodiment of the invention, a helical compression spring R whose axis is X (FIGS. 2 to 6) or, in a second embodiment which will be described later, a torsion spring R' (FIGS. 7 and 8).

In the first embodiment, the body 10 comprises a sliding sensitivity ring 30 translationally acted upon by the compression spring R. The compression spring R is applied on the one hand against the bottom of the cup 15 and on the other hand against the sensitivity ring 30 in order to act upon the latter axially.

The hand grip 20 has a grasping head 21 having the shape of a wing formed in an axial plane. The hand grip 20 furthermore comprises a central shank 22 which is connected to the head and extends axially in order to traverse the central opening 14, the driving part 50 being fixed by interlocking to the shank 22.

The hand grip 20 has a centering seat 23 (FIG. 6) which is applied against the internal face of the sleeve 13 and which has a groove or an annular shoulder in order to receive a lip seal 24 providing good fluid-tightness with the internal face of the sleeve. A groove 29 (FIGS. 4A to 4D) provided on the periphery of the grasping head 21 of the hand grip is able to house a sealing device 25 such as a conventional lip seal (see FIG. 9) which is applied against the internal face of the flange 12 of the body.

Figure 9:
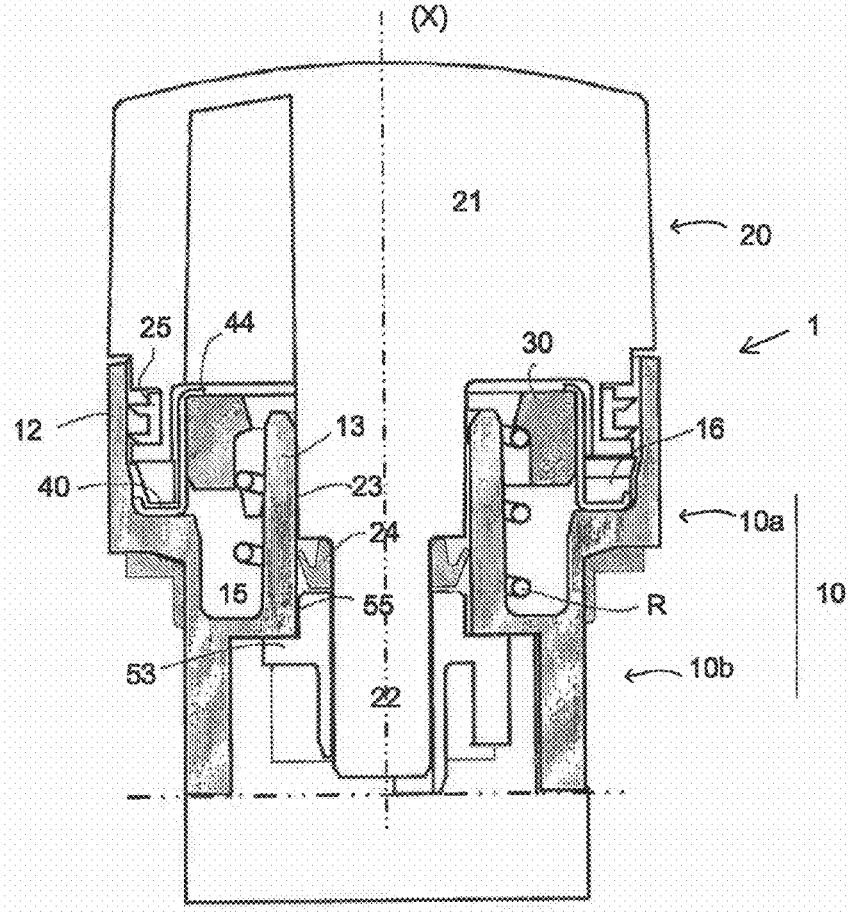
FIG. 9 is a diagrammatic axial cross-sectional view of a variant embodiment of the knob with maintained positions.

The lip seal is used if a certain total resistance force is tolerated. If it is desired to reduce this total resistant force, the sealing device 25 can be constituted by a chicane provided towards the flange 12, for example formed by a guard ring 40 (FIG. 9) housed in an annular space 16 concentric with the cup 15, stepped with respect to the latter. This guard ring can be provided in replacement of said lip seal or in addition to it as shown in FIG. 9.

The grasping head 21 of the hand grip has on its internal periphery actuating shapes 26 which cooperate with the ring 30. Finally, the shank 22 of the hand grip has shapes for indexing the driving part 50 (for example square as seen in FIG. 6) and interlocking shapes 27 upon which respective shapes of the part 50 interlock.

The sensitivity ring 30 has notches 31 or other similar recessed or relief shapes which allow it to slide axially against two slides 12*a* (FIG. 4A) of the body 10 formed in the stepped annular space 16; it must be noted that these slides can be also be provided on said guard ring 40. Furthermore, the ring 30 has shapes 32 provided for cooperating with the actuating shapes 26 of the hand grip. These shapes 32 (see FIG. 5) have slopes 32*a* and notches 32*b* corresponding to the desired functional positions of the knob.

The driving part 50 (FIG. 4B) has the shape of a tubular part having at its top a centering seat 55 in the opening 14 defined by the sleeve 13 inside the body 10 and at its bottom cam shapes for actuating the sliders 11. It also has an internal sleeve 51 having a constant square cross-section and in which the shank 22 of the hand grip 20 is inserted. Interlocking shapes 56 are provided on the internal surface of this sleeve 51 for cooperating with corresponding interlocking shapes 27 of the shank 22 of the hand grip. The driving part 50 furthermore comprises an external coaxial cylindrical skirt 53 having a lower rim 52 whose periphery defines the cam shapes. The skirt 53 forms with the centering seat 55 an annular shoulder 54 defining a transverse surface facing the lower rim of the internal sleeve 13 of the body 10.

In the annular space 16 of the body 10 there are two slides 12*a* provided with an engagement recess 12*b* for the guard ring 40 (FIG. 10) when the latter is provided.

Figure 10:
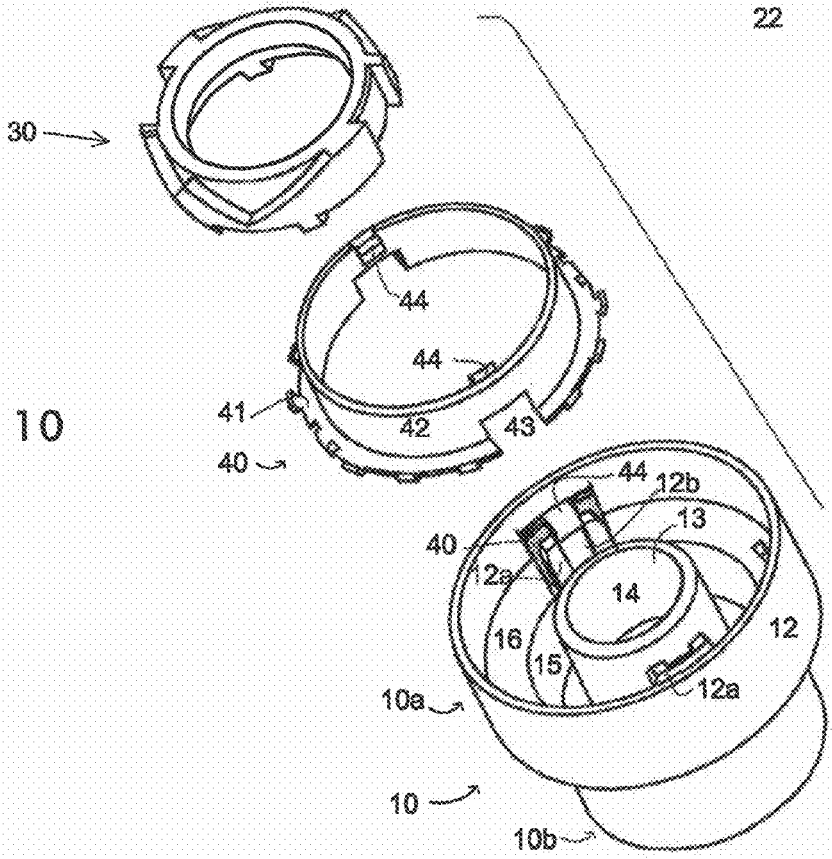
FIG. 10 is an exploded view of component parts of the knob shown in FIG. 9.

The guard ring 40 (FIG. 10) has a flange 41 fixed, for example force fitted, against the bottom of the cup 15, and a cylindrical skirt 42 provided with two diametrically opposite notches 43 which allow the ring 40 to sit on the sliding protrusions 12*a* (FIG. 10 shows for this purpose in its bottom part a portion of the ring 40 inserted in the body 10). At the level of the notches 43, the skirt 42 has stops 44, for example in the form of claws or tenons, which therefore retain the ring 30 against the spring R (FIG. 9).

The assembly and the operation of the rotary knob 1 according to the invention will be explained for the embodiment having a sensitivity ring. The spring R is placed at the bottom of the cup 15 and the ring 30 is slipped over the protruding slides 12*a*. The body/spring/ring 10, 30, R subassembly is then ready to receive the hand grip 20, added from the top into the body, and then the driving part 50 which is added from the bottom and engaged on the shank 22 of the hand grip and bearing by its shoulder 54 on the lower rim of the sleeve 13. The centering seats 23, 55 of the hand grip 20 and of the part 50, situated on the two sides of the lip seal 24, ensure perfect guidance of the rotary equipment 20, 50.

Figure 4A:
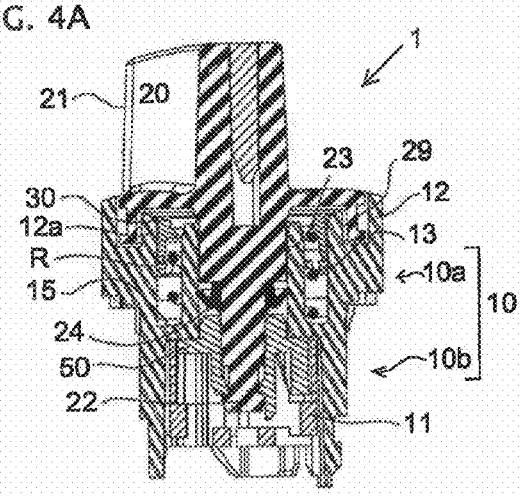
FIGS. 4A to 4C are longitudinal axial cross sectional views, through 4A-4A, 4B-4B, 4C-4C, 4D-4D respectively of FIG. 3, of the rotary knob with maintained positions shown in FIG. 2.
Figure 4B:
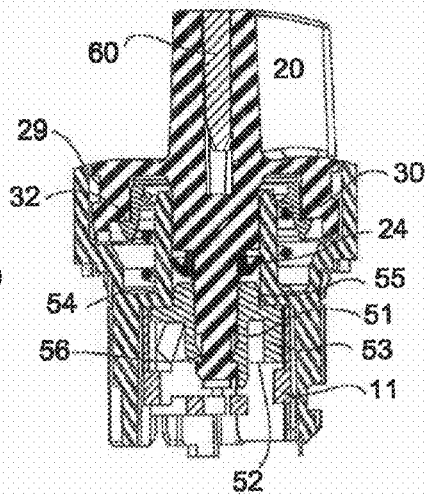
Figure 4C:
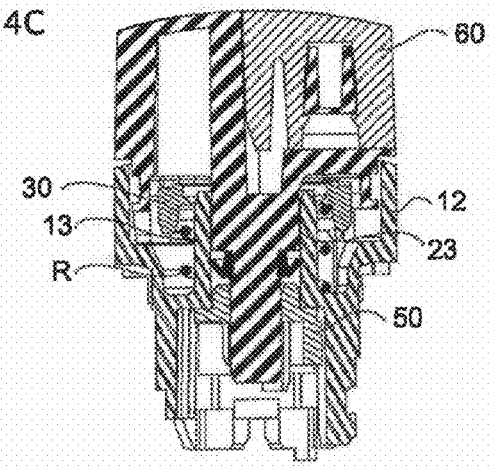
Figure 4D:
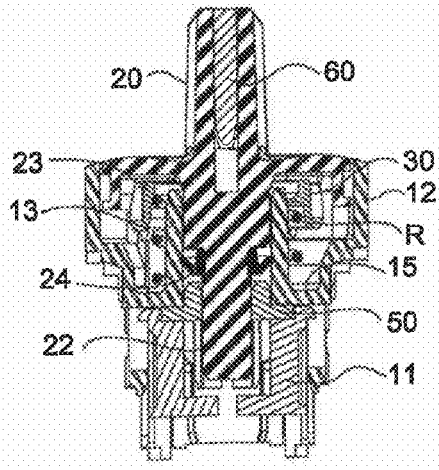
Figure 5:
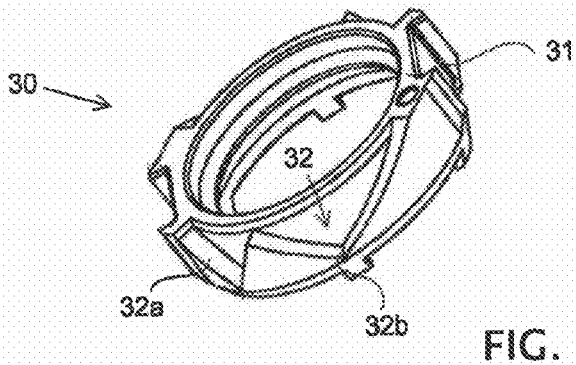
FIG. 5 is a perspective view of the sensitivity ring used in the rotary knob with positions shown in FIG. 2.

When the operator rotates the hand grip 20, the actuating shapes 26 cooperate with the cam shapes 32 of the ring 30 during the rotation; the pressure then applied on the spring R gives rise to a reaction force felt by the operator. When the hand grip arrives at the desired position, the spring pushes back a notch 32*b* of the ring towards the corresponding shape 26 such that the position remains maintained, and the axial movement of the ring remains limited by the hand grip 20 (FIG. 4B). The fluid-tightness of the interior of the knob is guaranteed by the lip seal 24 and possibly, if it is present, by the sealing device 25. The seal 24 is of small diameter and therefore gives rise to minimal resisting force.

In the second embodiment of the invention, the rotary knob 1' is called a return knob and uses a torsion spring R' in replacement of the compression spring R. The latter is fixed on the one hand to the bottom of the cup 15 and on the other hand to the hand grip 20 in order to return the latter in a rotary manner.

In this embodiment, shown in FIGS. 7 and 8, the body has an intermediate internal flange 17 separating the cup 15 from the previously defined annular space 16. The hand grip 20 has a reentrant skirt 28 in the annular space 16. The presence of the sleeve 13 and of the intermediate flange surrounding the spring R', combined with the presence of the reentrant skirt 28 of the hand grip, produce the sought fluid-tightness. The other features of the rotary return knob 1' are identical to those of the rotary knob 1 with positions.

The invention claimed is:

1. A rotary knob for an electrical system, comprising:

a body;

a rotary maneuvering member mounted on the body in a fluid-tight manner; and a driving part housed in the body and provided with cam surfaces on a circumference thereof, wherein the maneuvering member includes a shank for moving the driving part, the body supports at least one electrical block being switchable in response to a rotation of the maneuvering member via at least one axially moving slider disposed around the cam surfaces of the driving part, the maneuvering member is mounted in a rotary manner about an axis with a limited angular movement, in order to assume at least two functional positions, and is locked in rotation with the driving part provided with the cam surfaces for moving the sliders, the body of the knob includes a hollow part provided with an external cylindrical flange, an internal cylindrical sleeve and a cup defined between the flange and the sleeve, the cup houses either a helical spring acting on a sensitivity ring separate from the driving part and movable in translation or a torsion spring acting on the maneuvering member, and the cylindrical sleeve defines a central opening with which a centering seat of the shank of the maneuvering member cooperates.

2. The rotary knob as claimed in claim 1, wherein the shank of the maneuvering member and the driving part each includes a cylindrical seat ensuring the centering, in the central opening of the sleeve, of the maneuvering member and the driving part.

3. The rotary knob as claimed in claim 1, wherein the driving part is mounted by interlocking portions on the shank of the maneuvering member, the driving part having a shoulder connected to a seat thereof that is applied axially against a bearing face of the body.

4. The rotary knob as claimed in claim 1, wherein the compression or torsion spring housed in the cup has a height substantially equal to a height of the cylindrical sleeve.

5. The rotary knob as claimed in claim 1, wherein, when the cup houses the sensitivity ring and a compression spring, the sensitivity ring is separate from the driving part, coaxial with the maneuvering member, movable in translation, has a diameter corresponding to that of the cup, cooperates with the maneuvering member with cam portions provided on respective peripheries thereof and is provided with notches corresponding to the functional positions.

6. The rotary knob as claimed in claim 5, wherein there is, between the external cylindrical flange of the body and the cup, an annular space stepped with respect to the cup and configured to house a sealing device.

7. The rotary knob as claimed in claim 6, wherein the maneuvering member is a hand grip that has a head provided with a reentrant annular rim, the annular space houses the annular rim and a guard ring with a cylindrical skirt, a first radial annular interstice is provided between the flange and the annular rim and a second radial annular interstice is provided between the annular rim and the cylindrical skirt, the two interstices in series forming a sealing chicane.

8. The rotary knob as claimed in claim 7, wherein the guard ring has a stop which limits the movement of the guard ring against the force of the spring.

9. The rotary knob as claimed in claim 6, wherein, when the cup houses a torsion spring, a chicane sealing device is provided between the cylindrical flange of the body and comprises a skirt of the head and an intermediate cylindrical flange of the body separating the cup from the annular space.

10. A rotary knob for an electrical system, comprising:

a body including a hollow part provided with an external cylindrical flange, an internal cylindrical sleeve and a cup defined between the flange and the sleeve;

a driving part housed in the body; and a rotary maneuvering member mounted on the body in a fluid-tight manner, the maneuvering member including a shank for moving the driving part, wherein the body supports at least one electrical block being switchable in response to a rotation of the maneuvering member via at least one axially moving slider, the maneuvering member is mounted in a rotary manner about an axis with a limited angular movement to assume at least two functional positions, and is locked in rotation with the driving part provided with cam surfaces for moving the sliders, the cup houses either a helical spring acting on a sensitivity ring separate from the driving part and movable in translation or a torsion spring acting on the maneuvering member, the cylindrical sleeve defines a central opening with which a centering seat of the shank of the maneuvering member cooperates, and when the cup houses the sensitivity ring and a compression spring, the sensitivity ring is separate from the driving part, coaxial with the maneuvering member, movable in translation, has a diameter corresponding to a diameter of the cup, cooperates with the maneuvering member with cam portions provided on respective peripheries thereof, and is provided with notches corresponding to the functional positions.

* * * * *